United States Patent [19]

Atkey

[11] 3,968,860

[45] July 13, 1976

[54] HYDRAULIC ELEVATOR INSTALLATION

[75] Inventor: Richard E. Atkey, Memphis, Tenn.

[73] Assignee: Dover Corporation, Memphis, Tenn.

[22] Filed: Oct. 25, 1974

[21] Appl. No.: 514,893

[52] U.S. Cl. ..... 187/17; 187/95

[51] Int. Cl.² ..... B66B 9/04

[58] Field of Search ..... 187/17, 1 R, 95; 92/51, 92/52, 61, 66, 109, 110, 117 R, 117 A; 254/89 H, 93

[56] References Cited

UNITED STATES PATENTS

| | | | |
|---|---|---|---|
| 344,038 | 6/1886 | Fitts | 187/17 |
| 454,872 | 6/1891 | Krell | 187/17 |
| 1,799,298 | 4/1931 | Jakob | 254/93 H X |
| 2,935,301 | 5/1960 | Olivier | 254/93 R X |
| 3,252,680 | 5/1966 | Lee | 92/52 X |

FOREIGN PATENTS OR APPLICATIONS

| | | | |
|---|---|---|---|
| 1,049,705 | 1/1959 | Germany | 92/117 R |
| 874,404 | 8/1961 | United Kingdom | 254/93 R |

*Primary Examiner*—Evon C. Blunk
*Assistant Examiner*—James L. Rowland
*Attorney, Agent, or Firm*—Brumbaugh, Graves, Donohue & Raymond

[57] ABSTRACT

An hydraulic jack for an elevator installation comprises a pair of cylinders and a common plunger. One cylinder is fixedly mounted in a vertical position in a hoistway; while one end of the plunger is mounted within the fixed cylinder for vertical reciprocating movement therein. The other cylinder, which carries an elevator cab up and down in the hoistway, is slidably mounted about the other end of the plunger for vertical reciprocating movement thereon.

1 Claim, 6 Drawing Figures

HYDRAULIC ELEVATOR INSTALLATION

The present invention relates to hydraulic elevator installations, and, more particularly, to a novel and improved hydraulic jack which utilizes a movable cylinder and movable plunger above the ground, wherein the movable cylinder reciprocates at the same velocity whether the plunger is at rest or moving with the movable cylinder.

In practice, hydraulic elevator systems have been conventionally actuated by a central plunger of an hydraulic jack, which supports an elevator cab adjacent the upper end of the plunger. The plunger is extensibly supported within a cylinder, which is sunk into the ground to a depth sufficient to permit an elevator cab to rest at the lowest floor level served when the plunger is fully retracted.

In this type of installation, the amount of desired elevator cab travel determines the contracted length of the plunger and cylinder combination, and thus the depth to which the cylinder must be sunk into the ground. However, the drilling of a hole of sufficient depth to receive the cylinder in proper alignment with a hoistway and installing a casing to line the hole are expensive operations.

Telescoping plungers have heretofore been used to reduce the depth of the hole required for the cylinder. However, since each extensible segment of the telescoping plunger has a different outside diameter, the speed at which each extensible segment travels varies from one to the other. This variation in speed is not particularly objectional when the telescoping plunger is used in conjunction with non-passenger type elevator installations limited specifically to the lifting of cargo and freight. However, the variation in speed between the various extensible segments of the telescoping plunger creates an undesirable effect which significantly reduces the feasibility of utilizing telescoping plungers in conjunction with passenger type elevator installations, such as those commonly employed in residential, apartment or office buildings.

Although conventional telescoping plungers may be modified to eliminate the variation in speed between the extensible segments, such modification involves a complex procedure entailing increased construction time and cost. Therefore, although it is possible to construct a telescoping plunger in which all of the extensible segments travel at the same speed, such an arrangement is commercially and economically impractical.

Furthermore, in prior hydraulic elevator installations the maximum travel is limited by the column strength of the plunger. Heretofore, plungers have been manufactured from a thick walled pipe or solid rod in an effort to produce a plunger with the necessary column strength to prevent buckling. Because of their weight, such plungers are more expensive and difficult to install and operate than a plunger manufactured from a thin walled pipe.

Another solution to the buckling problem is the provision of a follower guide to support the plunger. Conventionally, the follower guide runs on the guide rails and has a bearing surface which slidably engages the plunger. A system of cables is used to position the follower guide along the unsupported length of the plunger.

The sliding relationship between the follower guide and the plunger creates an undesirable possibility of the follower guide binding on the plunger, as well as not providing maximum support for the plunger. More particularly, since the correct positioning of the follower guide is mandatory for the safe operation of the lifting device, there must also be provided a safety mechanism for guarding against a failure in the positioning cables. Thus the utilization of the slidable follower guide necessitates a rather complex arrangement of positioning cables which increases the operating weight and cost of the lifting device.

In accordance with the invention, there is provided a novel and improved hydraulic elevator installation which normally includes a source of hydraulic fluid and a fluid pressure responsive hydraulic jack capable of vertical reciprocating movement. The hydraulic jack of the present invention includes a lower cylinder fixedly mounted in a vertical position; a pipe-like plunger having a lower end slidably mounted within the lower cylinder for vertical reciprocating movement therein; and an upper cylinder slidably mounted about an upper end of the plunger for vertical reciprocating movement thereon.

The plunger includes an axial bore which forms a passageway for hydraulic fluid between the lower and upper cylinders. Since only one plunger is employed and since the outside diameter of the plunger is constant, the upper cylinder will vertically reciprocate at the same velocity whether the plunger is at rest or moving with the upper cylinder to provide a smooth and continuous extension of the hydraulic jack.

When used in conjuction with an elevator installation the hydraulic jack of the present invention may be employed to vertically transport an elevator cab up and down in a hoistway. In an elevator environment, the upper cylinder is movably positioned above the ground; while the lower cylinder is buried in the ground. Thus the present invention saves construction time and cost by requiring only a relatively shallow hole to accommodate the lower cylinder, which need only be long enough to accommodate the lower end of the plunger.

Besides acting as an extensible portion of the hydraulic jack, the upper cylinder may also form a vertical support member of an elevator lifting frame, described more fully in my copending U.S. Pat. application Ser. No. 498,200, filed on Aug. 16, 1974. In general, the lifting frame further includes a lower horizontal support member rigidly attached to the upper cylinder and an upper horizontal support member rigidly attached to the upper cylinder and located a predetermined distance above the lower horizontal support member.

Two pairs of vertically aligned lower and upper rail guides of any suitable conventional form are carried by the lower and upper support members, respectively. The rail guides are engageable with a pair of parallel guide rails which extend upwardly in a hoistway in a vertical plane defined by the cylinder and the lower and upper horizontal support members. Thus the guide rails may be positioned adjacent the front end of the elevator cab rather than adjacent the central portion thereof, as is the conventional practice. Because the guide rails are so located, the hydraulic elevator installation of the present invention may also more readily benefit from various advantages attendant with a novel and improved rail mounting system, described more fully in my copending patent application Ser. No. 498,199, filed on Aug. 16, 1974.

To provide maximum support for the plunger, a follower guide may be rigidly attached to the plunger between the upper and lower cylinders. A pair of rail guides, carried by the follower guide and engageable with the guide rails, support the plunger at the point of attachment and reduces the unsupported length of the plunger between the upper and lower cylinders during the movement of the lifting frame in the hoistway.

Excessive upward vertical movement of the upper cylinder with respect to the plunger may be prevented by stop means located at the upper end of the plunger. Similarly, stop means located at the lower end of the plunger prevent excessive upward vertical movement of the plunger with respect to the lower cylinder.

For a more complete understanding of the invention reference may be had to the following detailed description taken in conjunction with the accompanying figures of the drawing, in which.

Figure 1:
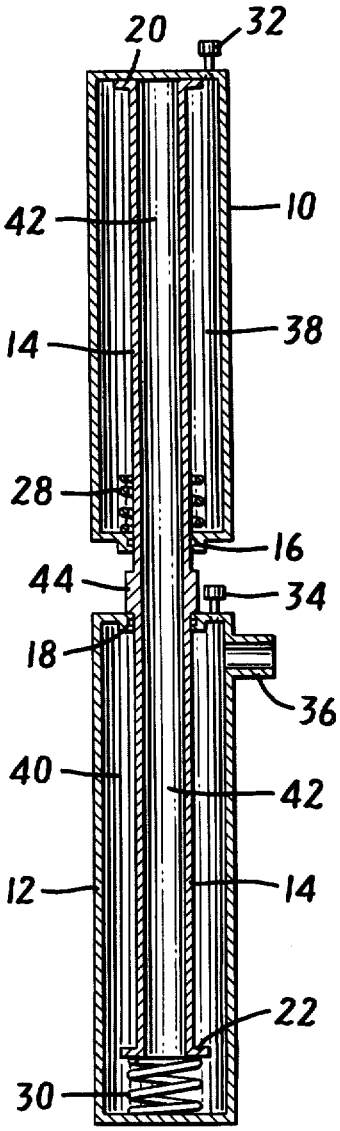
FIG. 1 is a cross-sectional view of the hydraulic jack of the present invention in a fully retracted position.
Figure 2:
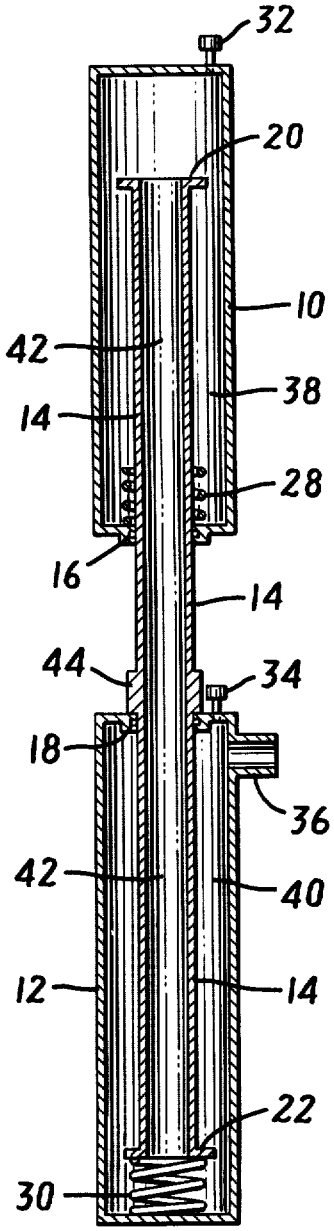
FIG. 2 is a cross-sectional view of the hydraulic jack of FIG. 1 with the movable cylinder partially extended.
Figure 3:
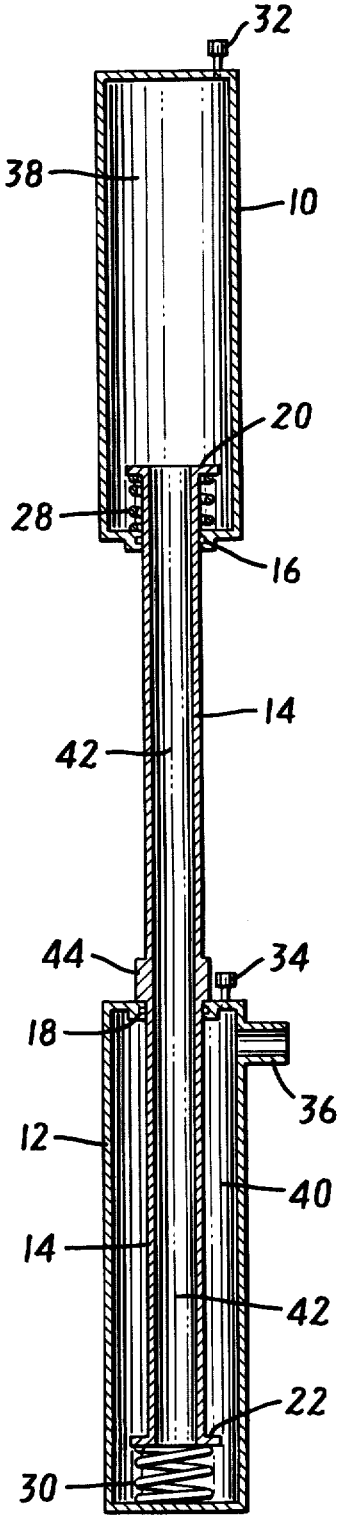
FIG. 3 is a cross-sectional view of the hydraulic jack of FIG. 1 with the movable cylinder fully extended.
Figure 4:
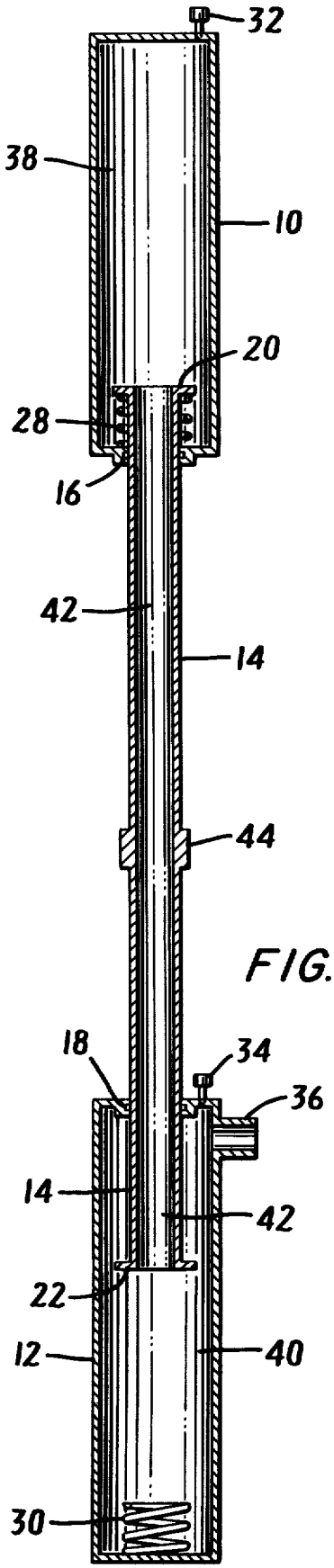
FIG. 4 is a cross-sectional view of the hydraulic jack of FIG. 1 with the movable cylinder fully extended and the plunger partially extended.
Figure 5:
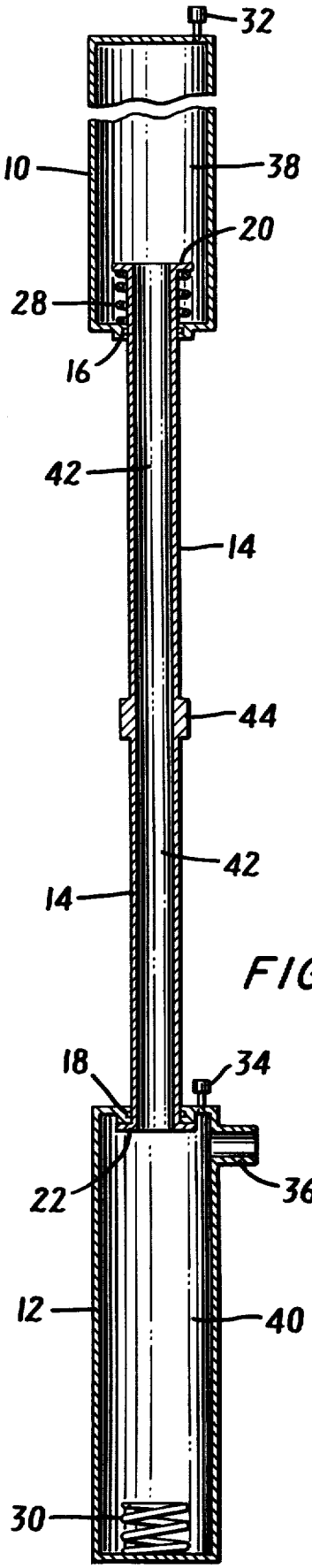
FIG. 5 is a cross-sectional view of the hydraulic jack of FIG. 1 with the movable cylinder fully extended and the plunger fully extended.

Referring to FIGS. 1–5, the hydraulic jack comprises a lower tubular cylinder 12 fixedly mounted in a vertical position; a hollow thin walled plunger 14, having a lower end slidably mounted within the lower cylinder 12 for vertical reciprocating movement therein; and an upper tubular cylinder 10 slidably mounted about an upper end of the plunger 14 for vertical reciprocating movement thereon. The lower end of the plunger 14 enters the lower cylinder 12 through an aperture in the upper surface of the lower cylinder 12; while the upper end of the plunger 14 enters the upper cylinder 10 through an aperture in the lower surface of the upper cylinder 10.

The lower cylinder 12 includes a bearing and seal combination 18, an hydraulic fluid inlet 36, a vent 34 and a spring 30. The bearing and seal combination 18 line the aperture in the upper surface of the lower cylinder 12 to provide a fluid-tight seal. Positioned externally of the lower cylinder 12 on the upper surface thereof is the vent 34 which permits the manual release of entrapped air from the lower cylinder 12. The inlet 36, which may be connected to a source of hydraulic fluid (not shown), is located in the side wall of the lower cylinder 12 adjacent the upper end thereof. From the lower surface of the lower cylinder 12, the spring 30 or other suitable energy absorbing device is supported in a chamber 40 of the lower cylinder 12. The spring 30 engages the lower end of the plunger 14 when the plunger 14 is fully retracted within the lower cylinder 12 to decelerate and stop the plunger 14.

The upper cylinder 10 includes a bearing and seal combination 16, a vent 32 and a spring 28. The bearing and seal combination 16 line the aperture in the lower surface of the upper cylinder 10 to provide a fluid-tight seal. Positioned externally of the upper cylinder 10 on the upper surface thereof is the vent 32 which permits the manual release of entrapped air from the upper cylinder 10. From the lower surface of the upper cylinder 10, the spring 28 or other suitable energy absorbing device is supported in a chamber 38 of the upper cylinder 10. The spring 28, which is disposed about the plunger 14, engages a flange 20 at the upper end of the plunger 14 when the upper cylinder 10 is fully extended on the plunger 14 to accelerate and lift the plunger 14.

The plunger 14 includes external flanges 20, 22 and 44. The flange 22 circumscribes the lower end of the piston 14 and acts as a stop to prevent the plunger 14 from extending completely out of the lower cylinder 12. Similarly, the flange 20 circumscribes the upper end of the plunger 14 and acts as a stop to prevent the upper cylinder 10 from extending completely off of the plunger 14. The flange 44 positioned approximately equidistant from the upper and lower ends of the piston 14 limits the length of the plunger 14 which may extend into the lower cylinder 12. More pertinently, the flange 44 prevents the upper cylinder 10 from crushing the vent 34 in the event of the failure of the spring 30. It should be understood that the flange 44 may be eliminated by increasing the length of the plunger 14 so that the length of the plunger 14 is greater than the sum of the lengths of the upper and lower cylinders 10, 12, respectively, by an amount greater than the height of the vent 34.

An axial bore 42 provided in the plunger 14 has an inlet located at the lower end of the piston 14 and an outlet located at the upper end of the plunger 14. Thus the bore 42 forms a fluid conduit between the lower cylinder 12 and the upper cylinder 10.

In operation, extension of the hydraulic jack is accomplished by forcing hydraulic fluid through the inlet 36 into the chamber 40 of the lower cylinder 12. The hydraulic fluid passes through the axial bore 42 in the plunger 14 and into the chamber 38 of the upper cylinder 10. Since there is no net hydraulic force on the piston 14, its weight prevents it from rising off of the spring 30 as the upper cylinder 10 moves upward (see FIG. 2). When the spring 28 engages the flange 20 located at the upper end of the plunger 14 (see FIG. 3), the upper cylinder 10 and the plunger 14 move upward together without any change in velocity of the upper cylinder 10 (see FIG. 4).

Upward motion of the upper cylinder 10 and the plunger 14 is normally terminated by controlling the flow of hydraulic fluid into the inlet 36. However, excessive motion of the upper cylinder 10 is prevented by the flange 20 contacting the spring 28. Similarly, excessive motion of the plunger 14 within the lower cylinder 12 is prevented by the flange 22 contacting the upper surface of the lower cylinder 12 (see FIG. 5).

Retraction of the hydraulic jack is accomplished by allowing the hydraulic fluid to escape through the inlet 36 in the lower cylinder 12. Gravity forces the upper cylinder 10 and the plunger 14 downward together until the plunger 14 is decelerated and stopped by the spring 30. The upper cylinder 10 continues downward at the same velocity until the escape of the hydraulic fluid is reduced to zero or until the plunger 14 contacts the upper surface of the upper cylinder 10.

Figure 6:
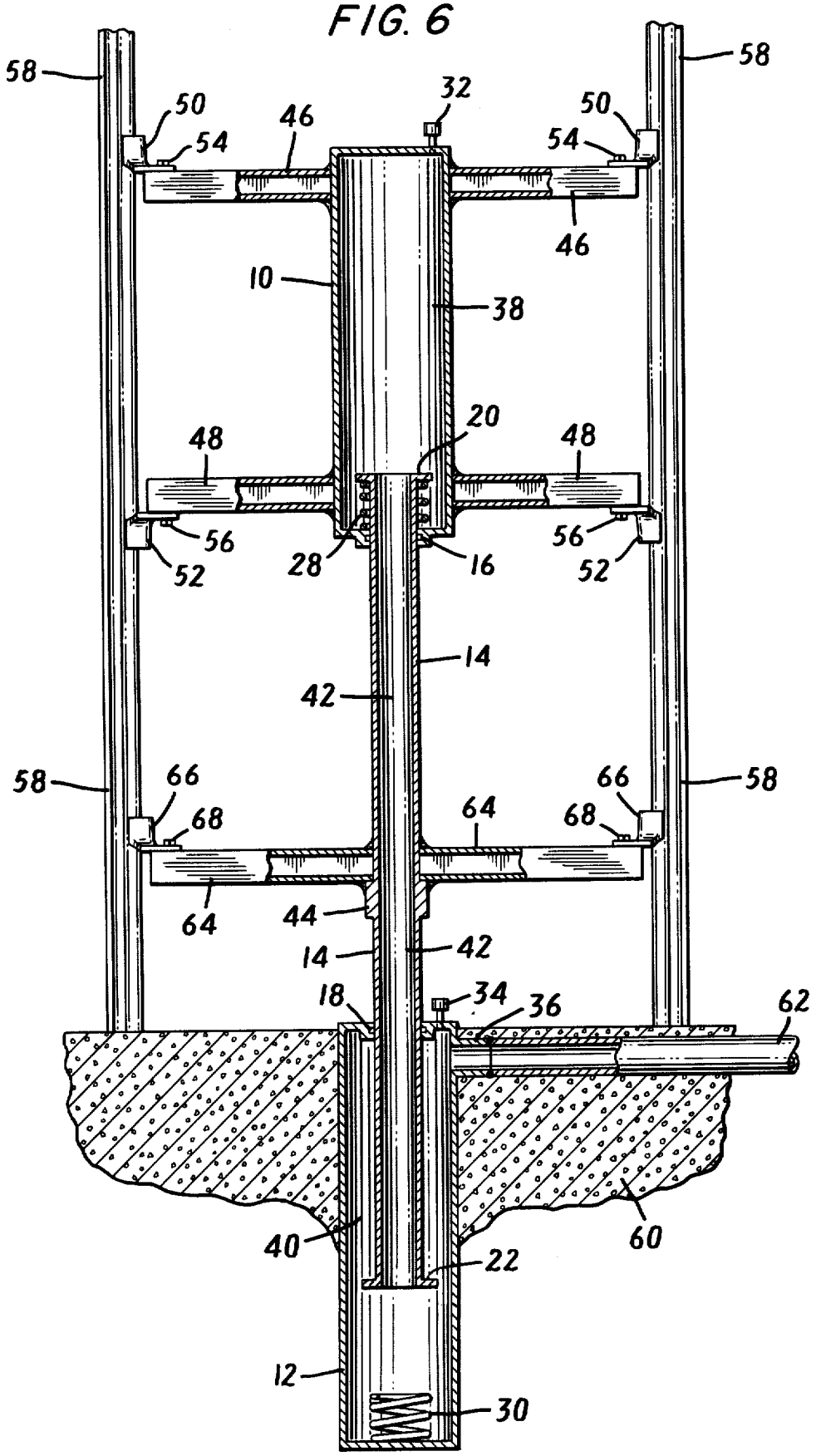
FIG. 6 is a front elevational view, partially cut away, of the hydraulic jack of FIG. 4 positioned in an elevator hoistway and equipped for transporting an elevator cab, in accordance with the invention.

In FIG. 6, the hydraulic jack of the present invention is shown mounted for vertical movement in a hoistway (not shown) of an elevator installation. The lower cylinder 12 is fixedly mounted in a vertical position in a hole provided in the floor 60 of the hoistway. The inlet 36 in the lower cylinder 12 is connected by a pipe or conduit 62 to a source of hydraulic fluid (not shown).

The upper cylinder 10 forms a rigidly integrated, vertical support member of a lifting frame for an elevator cab (not shown). The lifting frame further comprises a lower horizontal support member 48 rigidly attached by welding or other suitable means to the upper cylinder 10 and an upper horizontal support member 46 rigidly attached by welding or other suitable means to the upper cylinder 10 and located a predetermined distance above the lower horizontal support member 48.

The upper and lower horizontal support members 46, 48, respectively, are welded to the upper cylinder 10 intermediate the upper and lower surfaces thereof. Moreover, the lifting frame is designed such that the upper cylinder 10, the lower horizontal support member 48 and the upper horizontal support member 46 all lie within the same vertical plane. In the preferred embodiment of FIG. 6, the upper and lower horizontal support members 46, 48, respectively, are tubular elements having a rectangular cross-section. Although the hollow design reduces the weight of the lifting frame 10, it should be understood that any other suitable configuration or shape may be employed.

A pair of upper rail guides 50, 50 are attached to the upper horizontal support member 46 by bolts 54. Similarly, a pair of lower rail guides 52, 52 are attached, in vertical alignment with the upper rail guides 50, 50, to the lower horizontal support member 48 by bolts 56. The rail guides 50, 50 and 52, 52, which are shown as sliding type rail guides, may also be of the roller type. In any event, the upper rail guides 50, 50 and the lower rail guides 52, 52 are engageable with a pair of parallel T-shaped guide rails 58, 58 which extend upwardly in the hoistway and lie in a vertical plane defined by the upper cylinder 10 and the upper and lower support members 46, 48, respectively. The guide rails 58, 58 center the lifting frame during the vertical movement of the lifting frame in the hoistway.

To provide additional support for the plunger 14, a follower guide 64 may be rigidly attached by welding or other suitable means to the plunger 14 intermediate the upper and lower end thereof and between the upper cylinder 10 and the lower cylinder 12. Thus the follower guide 64 lies substantially in the same vertical plane as the upper cylinder 10, the upper horizontal support member 46 and the lower horizontal support member 48. In the preferred embodiment of FIG. 6, the follower guide 64 is a tubular element having a rectangular cross-section to minimize the weight of the hydraulic jack.

A pair of rail guides 66, 66 are attached to the follower guide 64 by bolts 68. The rail guides 66, 66, like the rail guides 50, 50 and 52, 52 are shown as sliding type rail guides, although the roller type may also be used. In any event, the rail guides 66, 66 are engageable with the pair of parallel guide rails 58, 58.

The rigid attachment of the follower guide 64 to the plunger 14 and the engagement of the rail guides 66, 66 carried by the follower guide 64 with the guide rails 58, 58 not only insures the correct and permanent positioning of the follower guide 64 between the upper cylinder 10 and the lower cylinder 12, but also maximizes the additional support provided by the follower guide 64 to the plunger 14.

In the preferred embodiment of FIGS. 1–6, the length of the plunger 14 is approximately equal to the sum of the lengths of the upper cylinder 10 and the lower cylinder 12. Moreover, the length of the upper cylinder 10 is approximately equal to the length of the lower cylinder 12. However, by decreasing the length of the lower cylinder 12 and increasing the length of the upper cylinder 10, the depth of the hole required for the lower cylinder 12 may be reduced.

Thus there is provided, in accordance with the invention, a novel and improved hydraulic jack for an elevator installation comprising a pair of cylinders and a common plunger, wherein one cylinder is fixed and the other cylinder is free for reciprocating movement at the same velocity whether the plunger is at rest or moving with the free cylinder.

It will be understood by those skilled in the art that the above-described embodiment is meant to be merely exemplary and that it is susceptible of modification and variation without departing from the spirit and scope of the invention. For example, the length of the cylinders and plunger may be varied as desired. Therefore, the invention is not deemed to be limited except as defined in the appended claims.

I claim:

1. An hydraulic elevator installation for vertically transporting an elevator cab up and down in a hoistway, comprising a source of hydraulic fluid; a fluid pressure responsive hydraulic jack including a first cylinder fixedly mounted in a vertical position, said first cylinder having an inlet connected to said source of hydraulic fluid for receiving hydraulic fluid therefrom, a plunger, said plunger having a first end slidably mounted within said first cylinder for vertical reciprocating movement therein, a second end and an axial bore forming a passageway for hydraulic fluid, and a second cylinder slidably mounted about said second end of said plunger for vertical reciprocating movement thereon, wherein said bore has an inlet located at said first end of said plunger and communicating with said first cylinder for receiving hydraulic fluid supplied to said first cylinder and an outlet located at said second end of said plunger and communicating with said second cylinder for supplying hydraulic fluid to said second cylinder, whereby said second cylinder reciprocates vertically on said plunger under the influence of fluid pressure conditions within said second cylinder and said plunger reciprocates vertically within said first cylinder, at the same velocity at which said second cylinder reciprocates on said plunger, under the influence of fluid pressure conditions within said first cylinder; a lifting frame for carrying the elevator cab, said lifting frame including said second cylinder, a lower horizontal support member rigidly attached to said second cylinder and an upper horizontal support member rigidly attached to said second cylinder and located a predetermined distance above said lower horizontal support member; a pair of parallel guide rails extending upwardly in the hoistway; two pairs of vertically aligned lower and upper guide means carried by said lower and upper horizontal support members, respectively, and engageable with said guide rails for centering said lifting frame between said guide rails during the vertical movement of said lifting frame in the hoistway; a follower guide rigidly attached to said plunger between said first and second cylinders; and a pair of guide means carried by said follower guide and engageable with said guide rails for supporting the portion of said plunger between said first and second cylinders during the vertical movement of said lifting frame in the hoistway.

* * * * *